US008926049B2

(12) United States Patent
Biglari et al.

(10) Patent No.: US 8,926,049 B2
(45) Date of Patent: Jan. 6, 2015

(54) METHOD TO EXECUTE A PAUSE FUNCTION DURING THE PRINTING OPERATION GIVEN AN INK PRINTING APPARATUS

(71) Applicants: Mehrad Biglari, Munich (DE); Admir Lela, Haar (DE); Peter Thiemann, Munich (DE); Stephan Pilsl, Roehrmoos (DE)

(72) Inventors: Mehrad Biglari, Munich (DE); Admir Lela, Haar (DE); Peter Thiemann, Munich (DE); Stephan Pilsl, Roehrmoos (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 13/948,211

(22) Filed: Jul. 23, 2013

(65) Prior Publication Data

US 2014/0160196 A1 Jun. 12, 2014

(30) Foreign Application Priority Data

Jul. 31, 2012 (DE) ..... 10 2012 106 967

(51) Int. Cl.

| | |
|---|---|
| ***B41J 29/38*** | (2006.01) |
| ***B41J 13/00*** | (2006.01) |
| ***B65H 23/18*** | (2006.01) |
| ***B41J 2/01*** | (2006.01) |
| ***B41J 15/16*** | (2006.01) |
| *B41J 2/155* | (2006.01) |

(52) U.S. Cl.

CPC ..... *B41J 13/0009* (2013.01); *B65H 23/18* (2013.01); *B41J 2/01* (2013.01); *B41J 15/16* (2013.01); *B41J 29/38* (2013.01)

USPC ..... 347/16; 347/14; 347/42; 347/104

(58) Field of Classification Search

CPC ..... B41J 15/16; B65H 23/18

See application file for complete search history.

(56) References Cited

U.S. PATENT DOCUMENTS

| | | | | |
|---|---|---|---|---|
| 6,431,674 | B2 | 8/2002 | Suzuki et al. | |
| 6,782,818 | B2 | 8/2004 | Glockner et al. | |
| 7,665,817 | B2 * | 2/2010 | Folkins | 347/14 |
| 2005/0137738 | A1 * | 6/2005 | Carlson et al. | 700/122 |
| 2013/0100194 | A1 | 4/2013 | Biglari et al. | |
| 2014/0055512 | A1 * | 2/2014 | Buschmann | 347/9 |

FOREIGN PATENT DOCUMENTS

| | | |
|---|---|---|
| DE | 10027471 | 8/2001 |
| DE | 102011054693 | 4/2013 |
| EP | 0788882 | 7/2002 |

* cited by examiner

*Primary Examiner* — Shelby Fidler

(74) *Attorney, Agent, or Firm* — Schiff Hardin LLP

(57) ABSTRACT

In a method to execute a pause in an ink printing system printing operation in which a printing substrate web is printed with print bars having print heads, with aid of a take-up roller moving the printing substrate web at printing speed past the print bars in a transfer printing zone in order to generate print images. Upon triggering the pause, a strain state of the printing substrate web is measured at a beginning of the pause and stored as a desired strain state. During the pause, the strain state of the printing substrate web is measured as a real strain state at selectable points in time, and the real strain state is compared with desired strain state. Given a deviation of the real strain state from the desired strain state, at the selectable points in time the take-up roller is controlled so that the strain state of the printing substrate web assumes the desired strain state at the beginning of the pause. After an end of the pause, the printing substrate web is transported with the take-up roller at the printing speed again.

7 Claims, 2 Drawing Sheets

METHOD TO EXECUTE A PAUSE FUNCTION DURING THE PRINTING OPERATION GIVEN AN INK PRINTING APPARATUS

BACKGROUND

Ink printing apparatuses can be used for single-color or multicolor printing to a printing substrate web (of a belt-shaped recording medium, for example) made of the most varied materials (paper, for example). The design of such ink printing apparatuses is known; see EP 0 788 882 B1. Ink printing apparatuses that operate according to the Drop on Demand (DoD) principle have a print head or multiple print heads with nozzles comprising ink channels, the activators of which nozzles—controlled by a printer controller—excite ink droplets in the direction towards the printing substrate web, which ink droplets are directed onto the printing substrate web in order to apply print dots there for a print image. The activators can generate ink droplets thermally (bubble jet) or piezoelectrically.

In the document DE 100 27 471 it is described that a change of the tension of the print medium—in particular transverse to the transport direction—is monitored and corrected via measurement and comparison of the circumferential velocities of the transport rollers (thus during the printing process).

Upon printing to a printing substrate web, it is sometimes necessary to hold the printing substrate web in a pause function during the printing operation, for example in order to monitor the register quality after printing a print job, or in order to remedy problems in the post-processing of the printing substrate web. After running the printing substrate back up, print image disruptions can then occur at those web segments that were located directly beneath the print heads after activation of the pause function. Due to the relatively large transfer printing zone in ink printing apparatuses (for example inkjet printing systems), in particular given color printing, the print image disruptions that are created due to the pause correspond to a great deal of spoilage. The occurring print image defects include print image distortions and color registration errors. The causes of these are the swelling or shrinking of the printing substrate web during the pause and—connected with these—the position shifts of the printing substrate web below the print heads (in particular in the longitudinal direction) since the printing substrate web below the print heads continues to remain under tension.

These problems are explained using FIG. 1. Of a printing apparatus DR, a printing unit 1 and a printer controller 2 are shown. The printing unit 1 is arranged along a printing substrate web 3, which printing unit 1 has the print bar 4 with print heads 5 in series as viewed in the transport direction PF0 of the printing substrate web 3. Given color printing, for example, a respective print bar 4 can be provided per color to be printed. The printing substrate web 3 is moved past the print bars 4 with the aid of a take-up roller 9; it thereby rests on a saddle with guide rollers 8. A rotary encoder or encoder roller 6 is arranged at the intake of the printing unit 1, which rotary encoder or encoder roller 6 is driven by the printing substrate web 3 and—depending on the feed movement of the printing substrate web 3—generates counting pulses that are supplied to the printer controller 2 and are used by the printing controller 2 to (for example) establish the point in time of the triggering of the printing process at the individual print heads 5. The printing substrate web 3 is supplied to the encoder roller 6 by a drive roller 7 arranged before the encoder roller 6.

In FIG. 1 it is now presented in principle how the printing substrate web 3 can be affected by the printing unit 1 or the environment air in individual web segments BA through the printing apparatus DR, for example given a standstill of the printing apparatus DR. The printing substrate web 3 is exposed to the environment air in the web segment BA1 between drive roller 7 and encoder roller 6, with the consequence that here a swelling of the printing substrate web 3 can occur due to the moisture of the environment air. The change of the printing substrate web 3 in the longitudinal direction that is due to this is, however, compensated with the aid of the encoder roller 6. In the web segment BA2 after the encoder roller 6, up to the printing unit 1, a swelling of the printing substrate web 3 due to the environment air can occur that, however, remains unconsidered by the encoder roller 6. This also applies for the web segment BA3 under the print heads 5 of the printing unit 1. In this transfer printing zone BA3, the printing substrate web 3 can shrink due to the operating temperature of the print heads 5. However, the printing substrate web 5 is also exposed to the environment air, such that the web segment BA3 can swell due to the moisture in the environment air, in particular given greater distances between the print bars 4. The two influences overlap. The printing substrate web 3 is thus exposed to different environment influences from the drive roller 7 up to the take-up roller 9, which environment influences can lead to either a shrinking or swelling of the printing substrate web 3. Since the printing substrate web 3 is furthermore directed under tension past the print bars 4, a displacement of the printing substrate web 3 under the print bars 4 results due to the length changes of the printing substrate web 3 that are caused by environment influences. This can lead to the print image errors mentioned above if the printing process is started again after an interruption of the printing operation.

The Application DE 10 2011 054 693 A1 (corresponding to US 2013/0100194 A1) describes a correction of the tension of the print medium during a printing pause to compensate for swelling or shrinking of the medium. For this, a web tension sensor in proximity to a rotary encoder wheel is used

SUMMARY

It is an object to specify a method in which the unwanted influences of the temperature and the environment air on the printing substrate web (and therefore on the print image) after triggering a pause function are minimized, in particular after ending a printing pause.

In a method to execute a pause in an ink printing system printing operation in which a printing substrate web is printed with print bars having print heads, with aid of a take-up roller moving the printing substrate web at printing speed past the print bars in a transfer printing zone in order to generate print images. Upon triggering the pause, a strain state of the printing substrate web is measured at a beginning of the pause and stored as a desired strain state. During the pause, the strain state of the printing substrate web is measured as a real strain state at selectable points in time, and the real strain state is compared with desired strain state. Given a deviation of the real strain state from the desired strain state, at the selectable points in time the take-up roller is controlled so that the strain state of the printing substrate web assumes the desired strain state at the beginning of the pause. After an end of the pause, the printing substrate web is transported with the take-up roller at the printing speed again.

DESCRIPTION OF PREFERRED EXEMPLARY EMBODIMENTS

Figure 1:
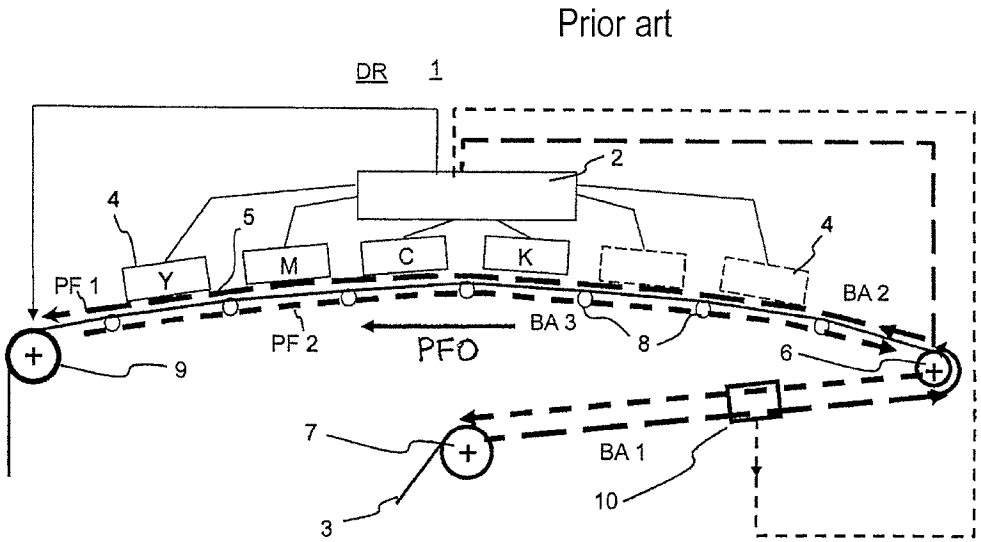
FIG. 1 is a principle presentation of a printing unit of an ink printing apparatus (prior art)

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

With aid of a take-up roller, in printing operation a printing substrate web under tension in a transfer printing zone is moved past print bars at print speed in order to generate print images on the printing substrate web. With triggering of a pause function, a strain state of the printing substrate web can be measured at a beginning of the pause and be stored as Desired_StrainState. During the pause, the strain state of the printing substrate web is measured at selectable points in time as Real_StrainState and is compared with the Desired_StrainState. Given a deviation of Real_StrainState from Desired_StrainState, the take-up roller can be controlled at the selectable points in time so that the strain state of the printing substrate web assumes the Desired_StrainState at the beginning of the pause. At the end of the pause, the printing substrate web then assumes the position at the print heads that it had assumed before the beginning of the pause. After the end of the pause, the take-up roller again transports the printing substrate at print speed past the print bars.

In an advantageous exemplary embodiment, the real value of the web tension of the printing substrate web can be measured with a web tension sensor, and the real value of the web tension can be regulated to a predetermined desired value of the web tension (called a desired operating value in the following) of the printing substrate web. This regulation of the web tension of the printing substrate web can also take place during a print pause. Upon triggering the pause function, the desired value of the web tension of the printing substrate web can then be varied, starting from the desired operating value, so that the printing substrate web assumes the Desired_StrainState and, after the end of the pause, assumes the position at the print heads that it had assumed before the beginning of the pause. After the end of the pause, the real value of the web tension of the printing substrate web is regulated again to the desired operating value of the web tension.

If a swelling of the printing substrate web occurs during the print pause, the desired value of the web tension is decreased after triggering the pause function, for example. Conversely, if the desired value of the web tension increases after triggering the pause function, for example, a shrinking of the printing substrate web occurs during the print pause.

To avoid the print image errors, the strain state of the printing substrate web in the transfer printing zone can be determined with the aid of two encoder rollers. A respective encoder roller can be arranged before and after the transfer printing zone, which encoder roller is driven by the movement of the printing substrate web and thereby outputs counting pulses. These counting pulses are counted, and count values are calculated from these at predetermined points in time. The difference of the count values can be determined, which is a measure of the movement of the printing substrate web in the transfer printing zone and a measure of the strain state of the printing substrate web. After triggering the pause function, the take-up roller is then controlled so that—at least after the pause—the printing substrate web assumes a strain state that corresponds to the strain state of the printing substrate web at the beginning of the pause (Desired_StrainState). This regulation can take place continuously during the pause.

Advantages of the method according to one exemplary embodiment are:

- A web segment of the printing substrate web that lay under the print bars before the pause lies under the print bars after the end of the pause. For example, this result can be achieved solely with the printer controller used to regulate the web tension of the printing substrate web.
- The print quality can be ensured independently of the respective climatic conditions and properties of the printing substrate web. A cost- and error-intensive climate sensor system for the environment of the printing apparatus and for the printing substrate web can thus be foregone.
- A complicated performance map, which includes values for the necessary web tension change for the different paper types given different moisture differences, is superfluous.

Figure 2:
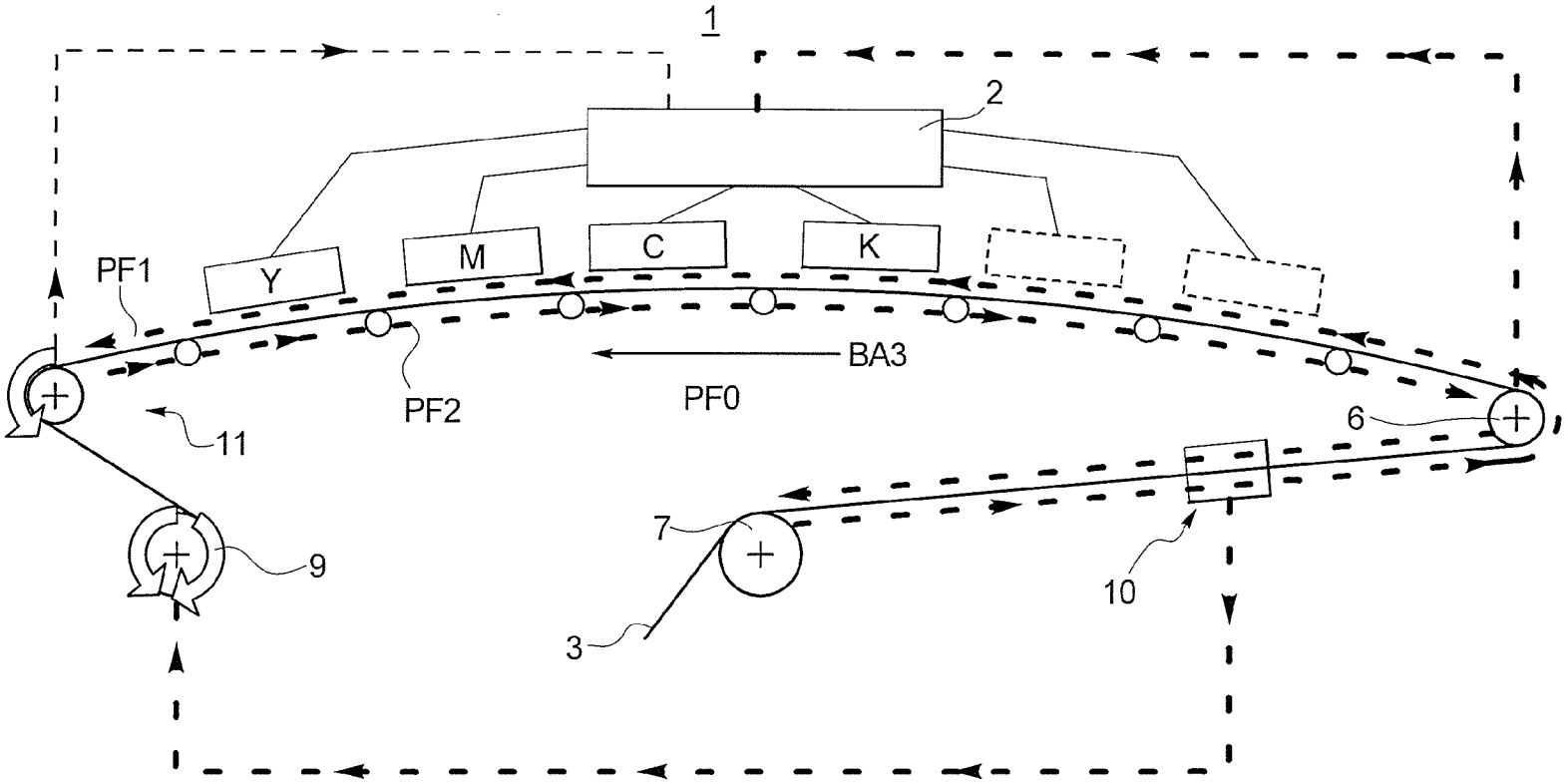
FIG. 2 is a principle presentation of a printing unit of an ink printing apparatus according to an exemplary embodiment.

An exemplary embodiment is explained further using drawing FIGS. 1 and 2.

The printing apparatus DR according to FIG. 1 can additionally have a web tension sensor 10 that is arranged adjacent to the printing substrate web 3, for example between the drive roller 7 and the encoder roller 6. In the printing operation, the real value of the web tension of the printing substrate web 3 that is determined by the web tension sensor 10 is compared with a predetermined desired value of the web tension (the desired operating value) and, given a deviation of the real value from the desired value, the web tension of the printing substrate web 3 can be regulated to the desired operating value again (for example by influencing the rotation speed of the take-up roller 9). The control circuit that is required for this can be arranged in the printer controller 2.

According to the exemplary embodiment, an encoder roller 11 (second encoder roller) at the output of the transfer printing zone BA3 is now provided in addition to the encoder roller 6 (first encoder roller) at the input of the transfer printing zone BA3. The encoder rollers 6, 11 are driven by the printing substrate web 3, rotate depending on the movement of the printing substrate web 3, and output counting pulses corresponding to the movement of the printing substrate web 3. The length change of the printing substrate web 3 can then be measured in a printing pause with the aid of the two encoder rollers 6, 11. For this, the counting pulses output by the encoder rollers 6, 11 are respectively counted, and the counter results are assessed as count values to determine the length change of the printing substrate web 3.

The count values of the encoder rollers 6, 11 are initially established at the beginning of the pause, and the difference of the count values of the two encoder rollers 6, 11 is used as a Difference_DesiredValue. The Difference_DesiredValue is a measure of the strain state D__0 (=Desired_StrainState) of the printing substrate web 3 at the beginning of the pause. Furthermore, the count values of the encoder rollers 6, 11 are determined at selectable points in time t during the pause, and the difference of these count values at the point in time t is calculated. These Difference_RealValues are respectively a measure of the Real_StrainState D_n of the printing substrate web 3 at the points in time t. The Difference_RealValues D_n are compared with the Difference_DesiredValue D__0, and the change ΔD of the strain state of the printing substrate web 3 is determined from this.

If a web tension sensor 10 is provided to regulate the web tension of the printing substrate web 3 (FIG. 2), the determined change ΔD of the strain state of the printing substrate web 3 can be used to change the desired operating value of the web tension regulation so that the change ΔD of the strain state of the printing substrate web 3 can be regulated to zero via modulation of the desired operating value of the web tension, for example via a rotation of the take-up roller 9.

If no web tension sensor should be used to affect the strain state of the printing substrate web 3, the determined change ΔD of the strain state of the printing substrate web 3 can be used in order to control the rotation direction of the take-up roller 9 so that the change ΔD of the strain state of the printing substrate web 3 approaches zero. This control can take place continuously via the ΔD values determined at the selectable points in time t.

The positions of the encoder rollers 6, 11 are thus measured as count values of the initial positions at the beginning of the printing pause, and the difference of the count values is calculated: the difference result is a measure of the Desired_StrainState D__0 of the printing substrate web 3 at the beginning of the pause (t=0):

$$D__0(D(t=0))=\text{Enc.2}-\text{Enc.1} \quad (1)$$

Enc. 1=Count value of the encoder roller 6

Enc. 2=Count value of the encoder roller 11

The difference value D__0 is the Difference_DesiredValue that can be used for the modulation of the desired web tension value, for example.

At predetermined points in time t within the pause, additional difference values D_n are determined as Difference_RealValues according to the formula (1) and are compared with the Difference_DesiredValue D__0, and the change ΔD of the strain state of the printing substrate web 3 is therefore determined. The goal of the regulation is now to maintain the Difference_DesiredValue (and therefore the Desired_StrainState) D__0 via modulation of the web tension, for example:

$$D__n-D__0=\Delta D \quad (2)$$

The change ΔD of the strain state of the printing substrate web 3 should now be kept at zero. The desired operating value of the web tension BZ_desired is changed, for example:

$$BZ_\text{desired}=BZ_\text{desired}+k\Delta D, \quad (3)$$

k is a correction factor that depends on the ratio of the web tension change to the length change of the printing substrate web and can be determined via measurement, for example.

If no web tension sensor should be used, the change ΔD of the strain state of the printing substrate web 3 can be used for the direct control of the take-up roller 9. Depending on whether ΔD is positive or negative, the drive roller 9 rotates in the one direction or the opposite direction. Since the control can take place at the selectable points in time t, the take-up roller 9 is rotated so that the change ΔD of the strain state of the strain state of the printing substrate web 3 will approach zero during the printing pause or that the printing substrate web 3 assumes the Difference_DesiredValue D__0 during the printing pause. If the dimension of the rotation of the take-up roller 9 is respectively known for a change ΔD of the strain state of the printing substrate web 3 for a paper type, the Difference_DesiredValue D__0 in the printing substrate web 3 can be adjusted with a measurement value.

The workflow of the method is explained in the following given use of a web tension sensor 10 and without use of a web tension sensor:

a) Use of a Web Tension Sensor 10

If the printing operation transitions into a pause, the problems illustrated above occur. For example, the printing substrate web 3 can swell during the pause if it is exposed to moisture, or it can shrink if it is exposed to heat:

In the first case, given swelling of the printing substrate web 3 in the printing pause the web tension decreases. Since the regulation continues to be active, in operation without use of the exemplary embodiment the web tension of the printing substrate web 3 would be brought again to the desired operating value during the printing pause, and the printing substrate web 3 would be moved forwards from the take-up roller 9 (Arrow PF1 in FIGS. 1 and 2).

In the second case, given shrinking of the printing substrate web 3 in the printing pause the web tension increases. Here, without use of the exemplary embodiment the web tension of the printing substrate web 3 would be reduced during the printing pause until the desired operating value of the web tension is reached, and the printing substrate web 3 would be moved backwards by the take-up roller 9 (Arrow PF2 in FIGS. 1 and 2).

In both cases, the printing substrate web 3 would be moved during the pause, with the result that the position of the printing substrate web 3 relative to the print heads 5 would have changed after the end of the pause in comparison to the position of the printing substrate web 3 before the pause. The result would then be that the print dots generated by print heads 5 that print to the printing substrate web 3 after the pause would be shifted relative to the desired position of these print dots, such that print image errors would occur.

In order to avoid these print image errors, according to the exemplary embodiment it is proposed to change the desired value of the web tension at the drive unit that regulates the web tension, starting from the desired operating position, so that displacement of the printing substrate web 3 in the transfer printing zone BA3 that is due to the length change of said printing substrate web (=change of the strain state of the printing substrate web 3) during the pause is negated. The regulation of the desired value of the web tension can thereby take place continuously during the printing pause.

In the first case (swelling of the printing substrate web 3), without the regulation according to the exemplary embodiment it would be sought to adjust the desired operating value of the web tension, with the result that the take-up roller 9 is moved in the direction of the arrow PF1. Given the regulation according to the exemplary embodiment, in the regulation the desired value of the web tension is decreased by such an amount from the desired operating value that the take-up roller 9 moves the printing substrate web 3 in the arrow direction PF2 until the encoder rollers 6, 11 output count values whose difference corresponds to the Difference_DesiredValue (=Desired_StrainState) D__0 at the beginning of the printing pause (t=0). The lengthening of the printing substrate web 3 that is generated by the swelling then does not lead to a shift of the position of the printing substrate web 3 under the print heads 5 after the end of the pause. The take-up roller 3 tensions the printing substrate web 3 such that the lengthening due to the swelling is compensated after the expiration of the pause.

The relationships in the shrinkage due to temperature increase of the printing substrate web 3 are treated accordingly. In the second case (shrinking of the printing substrate web 3) it would be sought to adjust the desired operating value of the web tension without the regulation according to the exemplary embodiment, with the result that the take-up roller 9 moves the printing substrate web 3 in the direction of the arrow PF2. Given the regulation according to the exemplary embodiment, the desired value of the web tension is increased from the desired operating value by such an amount, and the regulation is implemented, such that the take-up roller 9 moves the printing substrate web 3 in the direction of the arrow PF1 until the difference of the count values of the encoder rollers 6, 11 has reached the Difference_DesiredValue (Desired_StrainState) D_0. The desired value of the web tension is thus varied by such an amount that, via the regulation of the web tension of the printing substrate web 3, the printing substrate web 3 takes up the position relative to the print heads 5 at the resumption of the printing process that it had exhibited before the beginning of the pause. Print errors are therefore precluded.

b) The Implementation of the Method without Use of a Web Tension Sensor:

In the first case (swelling of the printing substrate web 3), the take-up roller 9 is controlled so that it moves the printing substrate web 9 in the arrow direction PF2 until the encoder rollers 6, 11 output count values whose difference corresponds to the Difference_DesiredValue D_0 at the start of the printing pause (t=0). The lengthening of the printing substrate web 3 that is generated by the swelling then does not lead to a shift of the position of the printing substrate web 3 relative to the print bars 4 after the end of the pause.

In the second case (shrinking of the printing substrate web 3), the take-up roller 9 is controlled so that it moves the printing substrate web 3 in the direction of the arrow PF1 until the encoder rollers 6, 11 output count values whose difference corresponds to the Difference_DesiredValue D_0. Upon resuming the printing process, the printing substrate web 3 therefore assumes the position that it had exhibited before the beginning of the pause.

The circuit components that are required for the implementation of the method according to the exemplary embodiment can be integrated into the printer controller 2. Since functions corresponding to Formulas (1) through (3) are to be executed via said components, they can be realized with known components that are familiar to the man skilled in the art.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to execute a pause in printing operation of an ink printing system with at least one printing apparatus in which a printing substrate web is printed with a printing unit with print bars having print heads, comprising the steps of:

with aid of a take-up roller moving the printing substrate web at printing speed past the print bars in a transfer printing zone in the printing operation in order to generate print images on said printing substrate web;

upon triggering the pause, a strain state of the printing substrate web at a beginning of the pause is measured and stored as a desired strain state;

during the pause, measuring the strain state of the printing substrate web as a real strain state at selectable points in time, and comparing the real strain state with the desired strain state;

given a deviation of the real strain state from the desired strain state at the selectable points in time, controlling the take-up roller so that the strain state of the printing substrate web assumes the desired strain state at said beginning of the pause; and after an end of the pause, transporting the printing substrate web with the take-up roller at said printing speed again.

2. The method according to claim 1 in which the strain state of the printing substrate web between respective encoder rollers is determined with aid of the respective encoder roller arranged respectively before and after the transfer printing zone of the printing apparatus, said encoder rollers being driven by the printing substrate web.

3. The method according to claim 2 in which a count value corresponding to a position of the encoder rollers is respectively established at the selectable points in time, and a difference of the count values of the encoder rollers is determined as a measure of the strain state of the printing substrate web.

4. The method according to claim 3 in which:

a difference of the count values of the encoder rollers at the beginning of the pause is determined as a difference desired value and as a measure of the desired strain state of the printing substrate web;

the difference of the count values of the encoder rollers is determined at the selectable points in time during the pause as a measure of difference real values and as a measure of the real strain states of the printing substrate web; and depending on the respective difference of the difference real value from the difference desired value at the selectable points in time, during the pause the take-up roller is controlled so that the encoder rollers moved by the printing substrate web output count values whose difference yields the difference desired value and therefore the desired strain state.

5. The method according to claim 3 in which:

a real value of the web tension of the printing substrate web is measured with a web tension sensor;

in the printing operation, the real value of the web tension is regulated to a predetermined desired operating value of the operating tension of the printing substrate web;

with triggering of the pause given further regulation of the web tension of the printing substrate web a desired operating value of the web tension of the printing substrate web is varied, starting from the desired operating value, so that the printing substrate web assumes a difference desired value, and therefore the desired strain state during the pause; and after an end of the pause, the real value of the web tension of the printing substrate web is again regulated to the desired operating value of the web tension of the printing substrate web.

6. The method according to claim 5 in which:

the difference of the count values of the encoder rollers at the beginning of the pause is determined as a difference desired value and as a measure of the desired strain state;

the respective difference of the count values of the encoder rollers is determined as difference real values at the selectable points in time during the pause;

the desired operating value of the web tension is changed depending on a difference of the difference real values from the difference desired value; and a rotation direction of the take-up roller for the printing substrate web is regulated during the pause with a modified desired operating value of the web tension, and the encoder rollers moved by the printing substrate web output count values whose difference yields the difference desired value, and therefore the desired strain state.

7. A method to execute a pause in printing operation of an ink printing system with at least one printing apparatus in which a printing substrate web is printed with a printing unit with print bars having print heads, comprising the steps of:

with aid of a take-up roller moving the printing substrate web at printing speed past the print bars in a transfer printing zone in the printing operation in order to generate print images on said printing substrate web;

upon triggering the pause, a strain state of the printing substrate web at a beginning of the pause is measured and stored as a desired strain state;

during the pause, measuring the strain state of the printing substrate web as a real strain state at selectable points in time, and comparing the real strain state with the desired strain state; and given a deviation of the real strain state from the desired strain state at the selectable points in time, controlling the take-up roller so that the strain state of the printing substrate web assumes the desired strain state at said beginning of the pause.

* * * * *